United States Patent [19]

Solovieff

[11] 4,297,862

[45] Nov. 3, 1981

[54] LOCK MECHANISM WITH REMOVABLE CYLINDER HOLDER

[76] Inventor: Paul G. Solovieff, 14291 Browning Ave., Apt. 52, Tustin, Calif. 92680

[21] Appl. No.: 14,418

[22] Filed: Feb. 23, 1979

[51] Int. Cl.[3] ..... E05B 9/08

[52] U.S. Cl. ..... 70/129; 70/451

[58] Field of Search ..... 70/370, 372, 373, 374, 70/381, 448, 449, 450, 451, 129

[56] References Cited

U.S. PATENT DOCUMENTS

| | | | |
|---|---|---|---|
| 3,606,422 | 9/1971 | Hennessy | 70/451 |
| 3,815,390 | 6/1974 | Stoia | 70/381 |
| 3,934,437 | 1/1976 | Crepinsek | 70/370 |

*Primary Examiner*—Robert L. Wolfe

*Attorney, Agent, or Firm*—Fulwider, Patton, Rieber, Lee & Utect

[57] ABSTRACT

A door lock including a mounting structure secured to a door, a bolt movable into an extended position in which it projects from an edge of the door, a lock cylinder for operating the bolt, and a holder in which the cylinder is mounted. A retaining mechanism, accessible through a release aperture on the edge of the door when the door is open, normally secures the holder to the mounting structure but permits the holder to be released to remove the cylinder.

The retaining mechanism can include a latch member that is engageable with the holder under the urging of a spring to prevent the holder from being removed from the mounting structure. Mutually engagable cam surfaces carried by the holder and the latch member cause movement of the latch member to permit installation of the holder. Alternatively, the latch member can be a screw, eliminating the need for a spring to urge it toward the holder. The holder can be installed by simple axial insertion into the mounting structure or by a combination of insertion and rotation.

18 Claims, 13 Drawing Figures

Fig. 9
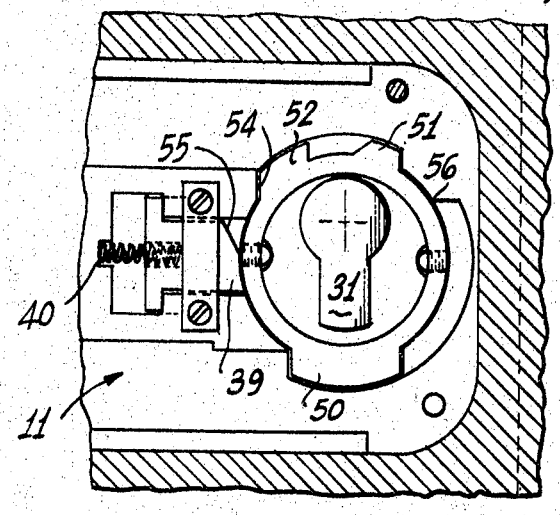
Fig. 10
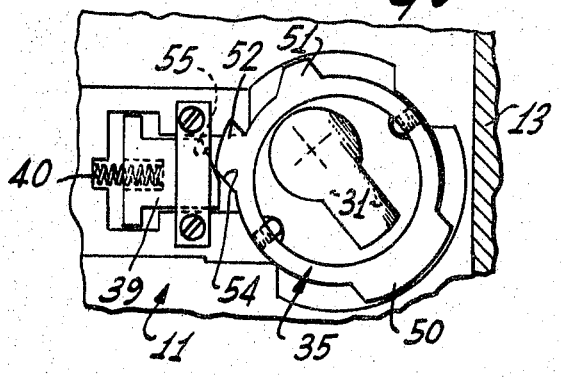
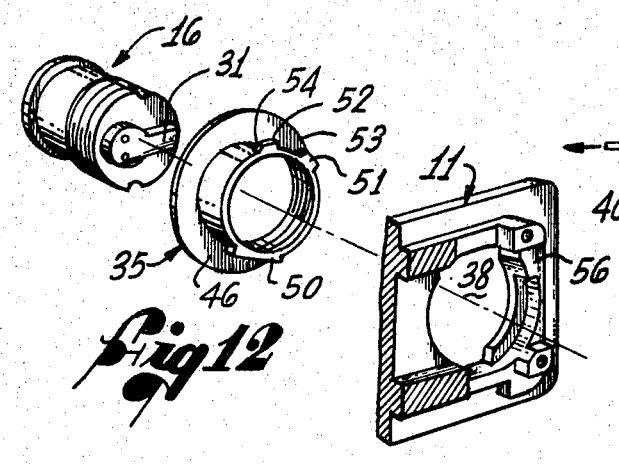
Fig 12
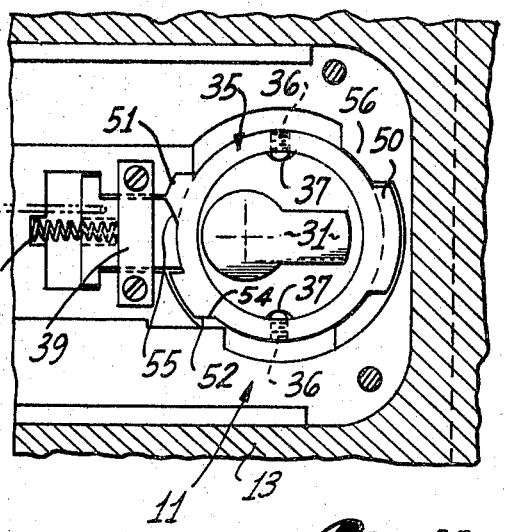
Fig. 11
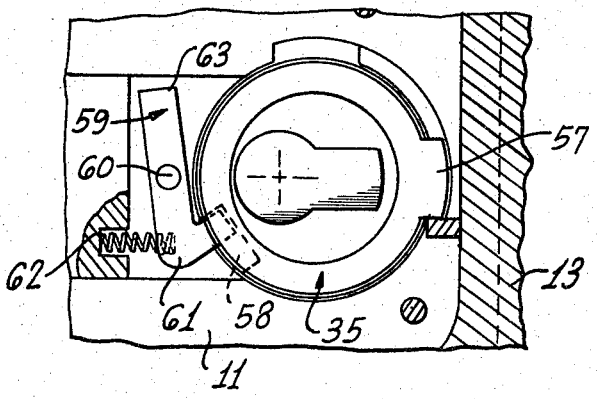
Fig. 13

LOCK MECHANISM WITH REMOVABLE CYLINDER HOLDER

BACKGROUND OF THE INVENTION

The present invention relates to locks, and, more particularly, to door locks of a type which can be readily modified to be operated by a variety of keys.

A conventional door lock utilizes a pair of escutcheons mounted on opposite sides of the door and connected by a face plate that covers the door edge. A bolt is movable laterally between the escutcheons so that it can be projected through the face plate and into a socket in a stationary door frame. Movement of the bolt is controlled by a lock cylinder to which it is connected by a bolt linkage.

The cylinder is the heart of the lock and typically contains an eccentrically located core in which a key can be inserted. A key of the correct configuration interacts with tumblers or other mechanisms to permit the core to be rotated, thereby causing the desired bolt movement. Alternatively, the cylinder can be actuated by a magnetically encoded key or by a thumb turn.

The lock cylinder is usually threaded externally and screwed into an aperture in one of the escutcheons. In a conventional mortise-type lock, a set screw extends inwardly from the edge of the door to engage a groove on the cylinder, preventing the cylinder from being rotated. To remove the cylinder, it is necessary to have access to the set screw which is covered by the frame when the door is closed, so that only a person who has a key to open the door can disassemble the lock.

The lock construction described above often makes it difficult to remove a cylinder, particularly if it has been in place for a long time and became bound tightly to the escutcheon. It has also been found that, in the case of an unusually wide door, the cylinder may not be long enough for the set screws to engage the cylinder groove.

A lock of conventional construction is particularly disadvantageous in situations in which it is desirable to change lock cylinders frequently and the process of disengaging the set screw and then unscrewing the cylinder is time-consuming and inconvenient. It should be remembered that lock cylinders have close threads that require many turns and care must be taken to avoid damaging the thread or defacing the lock while gripping and rotating the cylinder.

Situations in which it is desirable to change the lock cylinders frequently may arise from the need to more strictly control access to certain areas of a building during specified time periods. For example, personnel may be provided with keys that admit them to certain rooms during regular working hours, but these persons must be prevented from entering those rooms during non-working hours. A common practice is to alter the locks at the beginning and end of a work shift so that these keys will be usable only during the intended hours. It will be apparent that in this situation the rather tedious conventional method of changing lock cylinders is unsatisfactory.

One known solution to the above problem is to utilize a lock cylinder having a removable core. This core is adapted to receive two different keys. The first key merely opens the lock, while the second is a "control key" that allows the core to be removed from the cylinder. It is possible to control access by using the control key to change the core, leaving the rest of the lock unaffected. A disadvantage of this system, however, is that a removable core is complex and expensive. Moreover, a large portion of the core must be dedicated to control key operation, with the result that the portion of the cylinder available for operation by other keys is of reduced size and the lock is proportionately less secure. Another disadvantage of removable core cylinders is that they do not facilitate replacement of the entire cylinder since only the core is readily removable. It is often desired to replace the cylinder to substitute one that has a different keyway configuration, one that uses a magnetically encoded key, or one that incorporates a thumb turn.

It is a primary objective of the present invention to provide an improved door lock in which the entire cylinder can be installed and removed easily and quickly, without sacrificing security, thereby overcoming disadvantages of the previously known interchangeable core locks.

SUMMARY OF THE INVENTION

The present invention resides in an improved and unique door lock in which a lock cylinder is mounted in a holder that is in turn releasably inserted in a mounting structure secured to the door. A retaining mechanism that normally secures the holder is accessible from an edge of the door to release the holder when the door is open.

According to a preferred construction, a pair of opposing escutcheons form the mounting structure. A bolt is movable laterally between the escutcheons to project through an opening in a face plate on the door edge and a bolt linkage extends from the bolt to the lock cylinder. The retaining mechanism, which may be accessible from the edge of the door, as through a release aperture in the face plate, includes a movable latch member and a spring which urges the latch member toward the holder. When the latch member is moved to a released position, the holder and the cylinder can be removed.

It is advantageous for the holder to be ring-shaped and internally threaded to receive external threads on the cylinder. In one embodiment, the ring carries one or more outwardly projecting lugs which prevent rotation from a secured position to a released position prior to actuation of the latch mechanism. The lug and the latch member may have mutually engagable cam surfaces by which the retaining mechanism is actuated in response to axial insersion or rotation of the holder to permit installation of the holder. One such lug may be located adjacent the core of the cylinder where the lock is most vulnerable.

The latch member can be reciprocable in a radial direction with respect to the cylinder or it can be in the form of a pivotable pawl that engages a recess in the holder. In another embodiment, the latch member is formed by a set screw that is accessible from the edge of the door and engages a recess in the holder, thereby eliminating the need for a spring to urge the latch member toward the holder.

Other features and advantages of the present invention will become apparent from the following description, taken in conjunction with the accompanying drawings which illustrate, by way of example, the principles of the invention.

BRIEF DESCRIPTION OF THE DRAWINGS

FIGS. 9, 10 and 11 are fragmentary views similar to FIG. 7 showing a third embodiment of the invention with the holder of the lock in released, intermediate and secured positions, respectively;

FIG. 12 is an exploded view, on a reduced scale, of the holder, cylinder and a fragmentary portion of an escutcheon of a fourth embodiment of the invention; and FIG. 13 is another view similar to FIG. 7 showing the fourth embodiment of the invention.

BRIEF DESCRIPTION OF THE PREFERRED EMBODIMENT

Figure 1:
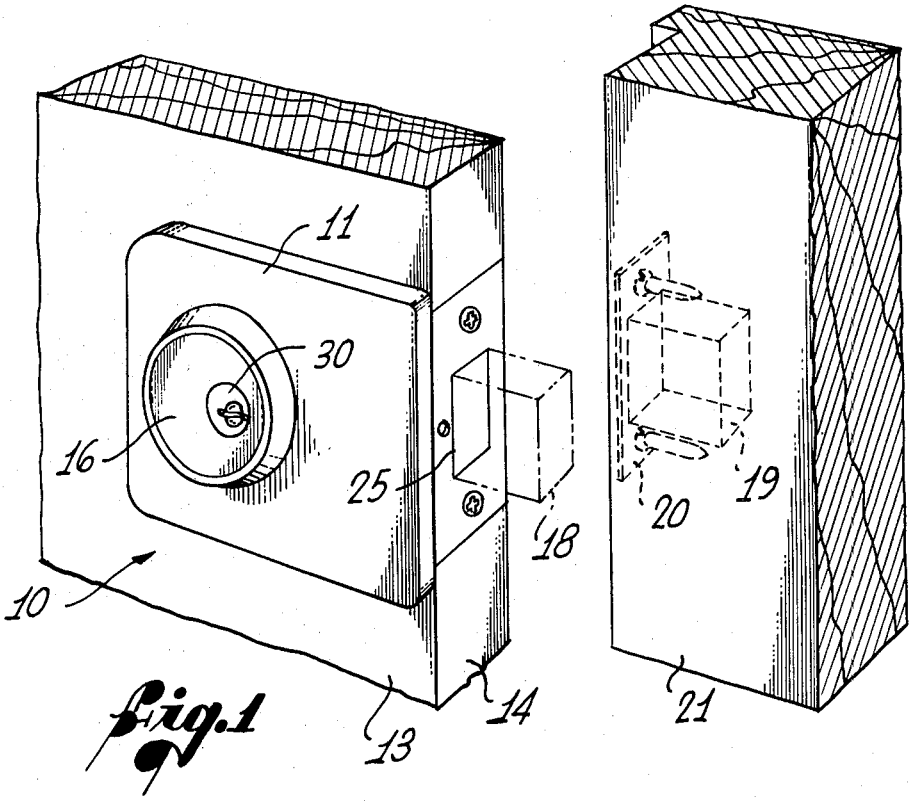
FIG. 1 is a fragmentary, perspective view of a door, slightly ajar, and a door frame, the door being equipped with a lock constructed in accordance with the present invention and the lock bolt being shown in phantom in its extended position.

An exemplary embodiment of the present invention resides in a high security unit lock 10, illustrated in FIGS. 1–7 of the accompanying drawings. In general, it includes first and second escutcheon plates 11 and 12 mounted on opposite sides of a door 13 near its swingable vertical edge 14, a face plate 15 that covers the edge, a key-operated lock cylinder 16 installed in the first escutcheon and a thumb turn-operated cylinder 17 installed in the second escutcheon. Between the escutcheons, a horizontally reciprocable lock bolt 18 can assume an extended position (shown in phantom in FIGS. 1 and 2) in which it can project into a socket 19 formed by a keeper 20 on an adjacent door frame 21 and a retracted position in which it is not engageable with the keeper and permits the door to be opened and closed freely. A linkage 22 (shown in FIG. 2) permits the bolt to be operatively connected to the cylinder.

Much of the basic structure of the lock 10 is described in U.S. Pat. Nos. 3,702,549 and 3,948,066 and will be set forth here in less detail. The escutcheons 11 and 12 are formed by castings, each having a relatively thin decorative outer cover 23. The second escutcheon 12 defines a guideway 24 in which the bolt 18, which is rectangular in cross-section, is slidable between its extended and retracted positions, a bolt aperture 25 being provided in the face plate 15 through which the bolt projects when extended.

Figure 2:
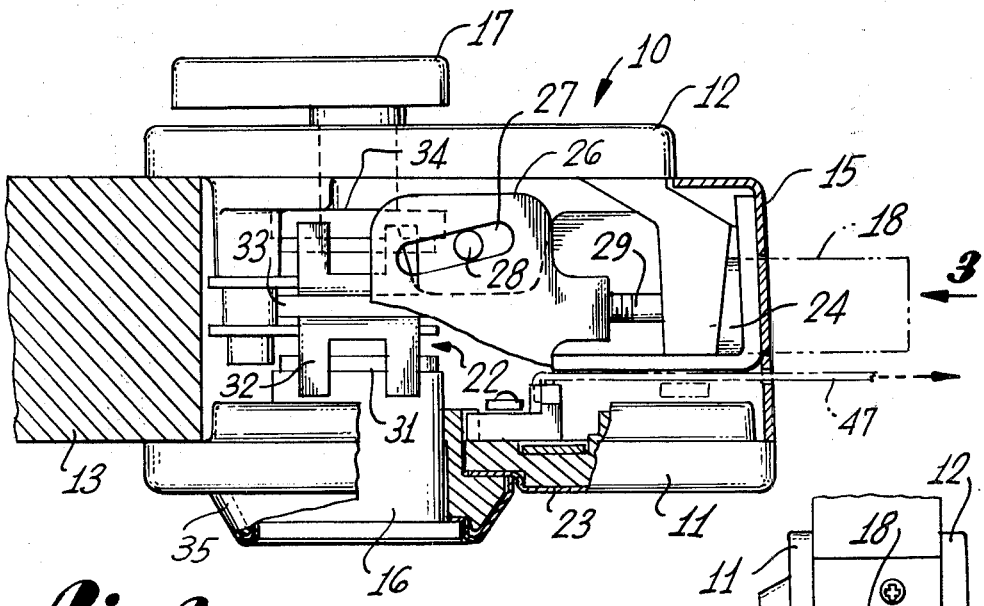
FIG. 2 is a partially broken-away plan view of the top of the lock.

At the top of the lock 10, a generally horizontal cam plate 26 defines oppositely inclined elongated slots 27 that receive upwardly projecting lugs 28 on the escutcheons 11 and 12 (one slot and the corresponding lug being shown in FIG. 2 in which a portion of the cam plate is broken away). An adjustment screw 29, the head of which is accessible once the face plate 15 is removed, engages a threaded bore (not shown) in the cam plate so that rotation of the screw causes linear movement of the plate toward or away from the door edge 14. As the plate moves, the escutcheons move apart or toward each other, depending on direction of plate movement. When the lock is installed, the adjustment screw is turned so that the escutcheons move inwardly, clamping the door 13 between them to provide a mounting structure by which the cylinders 16 and 17 and other lock components are supported.

One of the cylinders 16, which is of conventional construction and of a type sometimes referred to as a mortise cylinder, is mounted in the first escutcheon 11 and has an eccentric socket that receives a core or plug 30 (FIG. 1). The core has its longitudinal axis parallel to that of the cylinder and it can be rotated within the socket when a key (not shown) of the proper configuration is inserted. Rotation of the core causes corresponding rotation of an eccentrically mounted actuator 31, sometimes known as a "cam", on the inner end of the cylinder.

As the actuator 31 is rotated, it engages the linkage 22 to extend or retract the bolt 18, depending upon the direction of rotation. The linkage includes two oppositely extending, slotted, linkage plates 32 that are rotatable in unison about the axis of the cylinders 16 and 17 and an elongated bolt link 33 (partially visible in FIG. 2) that is pivotably connected to the plates at one end and to the bolt at the other end. A latch spring (not shown) biases the linkage plates toward either of two extreme positions, one in which the bolt is fully extended and one in which it is fully retracted. The linkage thus forms a dead bolt toggle mechanism.

It should be noted that this first embodiment of the invention employs only one key operated lock cylinder 16 that is engageable, through its actuator 31, with only one of the two linkage plates 32. On the other side of the lock 10, the thumb turn cylinder 17 mounted in the second escutcheon 12 carries a similar actuator 34 for engagement with the other plate but does not require a key. Cylinders operated by keys and thumb turns are interchangably installable in the second escutcheon and a cylinder of the desired type may be selected in view of the requirements of the location in which the lock is to be used.

Figure 4:
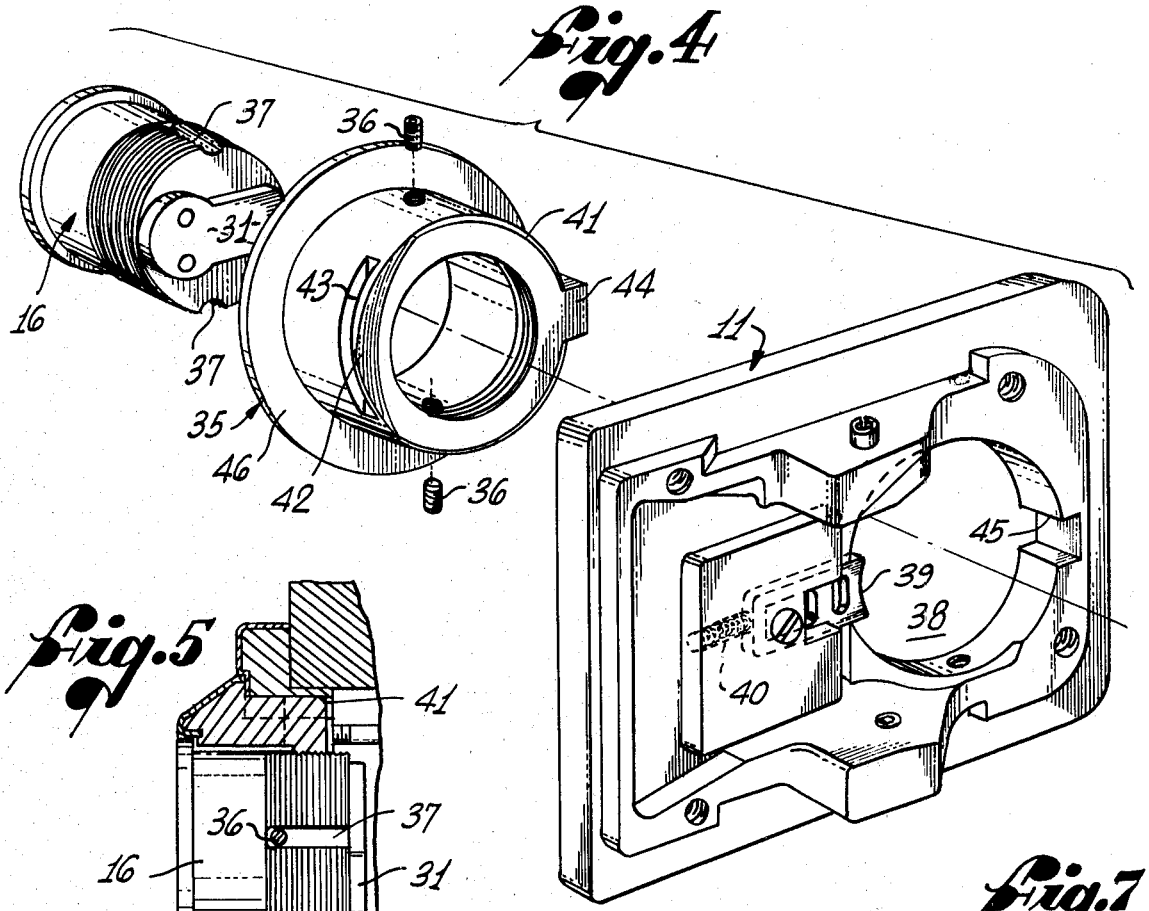
FIG. 4 is an exploded view of the cylinder, holder and one escutcheon of the lock.
Figure 5:
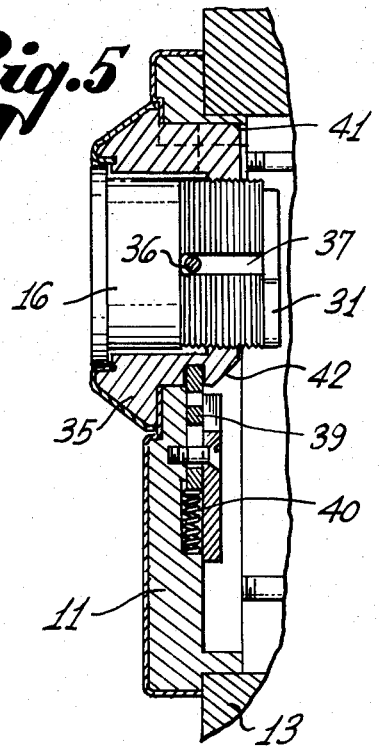
FIG. 5 is an enlarged, cross-sectional view taken vertically through a fragmentary portion of the lock that includes the cylinder and holder.
Figure 7:
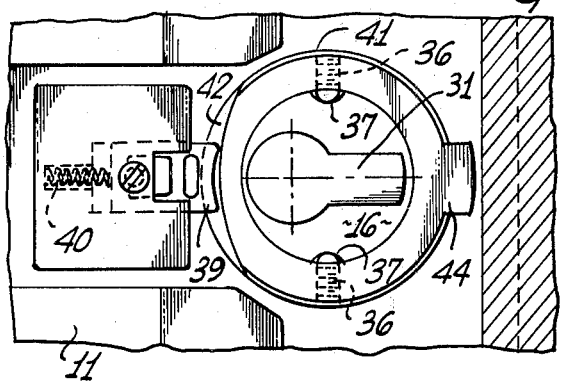
FIG. 7 is a fragmentary, internal view of the lock showing the holder and cylinder installed in the escutcheon.
Figure 6:
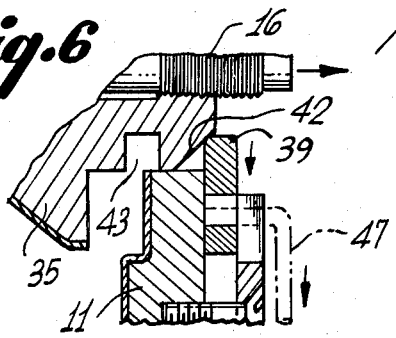
FIG. 6 is a further enlarged, fragmentary, cross-sectional view of the lock showing the holder and cylinder partially inserted in the escutcheon.

In accordance with the invention, the lock 10 is provided with a unique ring-shaped cylinder holder 35 that permits the key-operated cylinder 16 to be quickly and easily removed from the first escutcheon 11. The holder is threaded internally to receive the externally threaded cylinder. Allen screws 36 that project downwardly from the top and upwardly from the bottom of the holder engage grooves 37 extending axially along the cylinder to prevent it from turning (FIG. 4).

The holder 35 is inserted axially in an aperture 38 in the face of the first escutcheon 11 and held by a retaining mechanism in the form of a radially reciprocable latch member 39 that is biased toward the holder by a spring 40. Although the holder and aperture shown here are circular, corresponding non-circular configurations may be chosen to prevent rotation of the holder. The latch member is generally flat and plate-like and slides in a track formed by the escutcheon.

When the holder 35 and cylinder 16 are properly positioned in the escutcheon 11, being easily inserted due to a beveled circumferential edge 41 on the inner end of the holder, the latch member 39 is engaged by a cam surface 42 of the holder and pushed radially outwardly. It then snaps back under the urging of the spring 40 and enters an outwardly facing recess 43 on the outer surface of the holder (FIGS. 4, 5, 6 and 7). A lug 44 that projects from the holder on the side opposite the recess is received by a notch 45 in the escutcheon to further secure the holder against rotation. On the exposed front end of the holder a circumferential flange 46 of larger diameter than the aperture overlies the outwardly facing surface of the escutcheon to prevent the holder from being pushed further into the lock 10. The flange 46 also secures the cover 23 to the escutcheon 11 to prevent its removal.

Figure 3:
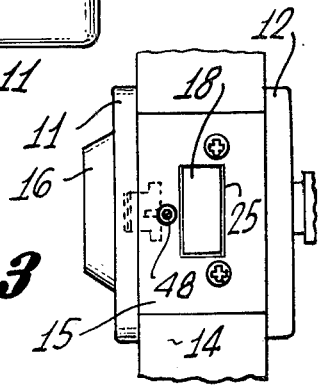
FIG. 3 is a side elevation of the lock, on a reduced scale, taken from the direction of the arrow 3 in FIG. 2.

When it is desired to remove the lock cylinder 16, an elongated tool in the form of a thin metal rod 47 with a hook on one end (shown in FIG. 2 and in phantom in FIG. 6) is inserted through a release aperture 48 in the face plate 15 (FIG. 3). By engaging the latch member 39 with the hook and pulling against the force of the latch spring 40, the latch member can be withdrawn from the recess 43, allowing the holder and cylinder to be easily and quickly removed.

Figure 8:
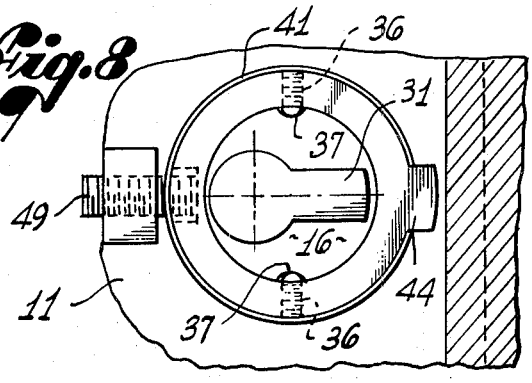
FIG. 8 is a view similar to that of FIG. 7 but showing a second embodiment of the invention.

A second embodiment of the invention, shown in FIG. 8, is similar to the lock 10 described above and the same reference numbers are used for corresponding elements. Instead of the slidably reciprocable latch member 39, however, it uses a set screw 49 accessible through the release aperture 48 to retain the holder 35. This use of a screw has the advantage of simplicity, eliminating the need for the latch spring 40 but the holder is not as easily installed and removed. Nevertheless the lock is superior to the more conventional arrangement in which a set screw directly engages the cylinder 16 since it is not necessary to unscrew the cylinder from the holder to remove it from the escutcheon 11.

Another embodiment of the invention, illustrated in FIGS. 9–12, is also similar to that of FIGS. 1–7 (corresponding components again being indicated by the same reference numbers). The ring-shaped holder 35 of this lock includes a single lug 50 on one side and two spaced-apart lugs 51 and 52 that define a recess 53 between them on the diametrically opposite side.

To insert the holder 35, it must be positioned so that the lugs 50, 51 and 52, which are arcuate in shape, are aligned with corresponding radially extending notches formed on the edge of the escutcheon aperture 38 (as shown in FIG. 9). Once the lugs have been inserted axially so that the flange 46 on the holder abuts the outer surface of the escutcheon 11, the holder is rotated 90 degrees counterclockwise to its secured position (FIG. 11). As the holder turns an inclined cam surface 54 on the leading edge of the last-mentioned lug 52 engages a cam surface 55 on the latch member 39, pushing the latch member away from the holder against the force of the latch spring 40. When the recess 53 is properly aligned, the latch member snaps forward under the force of the spring 40 and prevents further rotation of the holder. Simultaneously the lug 50 on the side of the holder opposite the latch member engages an abutment 56 on the escutcheon.

The holder 35 cannot be removed unless the latch member 39 is first withdrawn from its normal holder-engaging position within the recess 53. Otherwise the engagement of the lugs 51 and 52 with the latch member 39 prevents the necessary rotation of the holder prior to removal. As in the case of the first embodiment, the latch member can be disengaged from the holder by inserting a tool 47 through the release aperture 48 in the face plate 15 to move the latch member against the force of the latch spring 40. The holder can then be rotated clockwise to its released position (FIG. 9) and removed axially.

It should be noted that a lock 10 is sometimes attacked by inserting an implement in the keyway and pulling outwardly on the cylinder 16. The two recess-defining lugs 51 and 52 are, therefore, located adjacent the keyway of the off-center core 30 where the maximum force is apt to be applied.

A fourth embodiment of the invention, illustrated in FIG. 13, (again using the same reference numbers for corresponding elements), employs a holder 35 having only one lug 57. A recess 58 is formed by a radial depression in the outer surface of the holder instead of being formed between two lugs. The latch member, instead of being a slidable plate, is a pawl 59 pivotable on a pin 60 at its center. One end of the pawl carries a projection 61 that fits into the recess being held by the force of a spring 62. This embodiment has the advantage that it is not necessary to grip the latch member and pull it to disengage the holder. Instead, the free end 63 of the pawl is simply pushed by an implement inserted in the release aperture, causing the projection to swing out of the recess as the pawl pivots.

It will be appreciated from the foregoing that the invention provides a lock in which the cylinder can be quickly and easily replaced by a relatively unskilled person using simple tools. This objective is accomplished without significantly increasing the cost, size or complexity of the lock. Moreover, the security of the lock is not compromised by the removability of the cylinder. In fact, the holder provides extra protection against an attack on the exposed end of the cylinder.

While particular forms of the invention have been illustrated and described, it will also be apparent that various modifications can be made without departing from the spirit and scope of the invention.

I claim:

1. A door lock including a pair of escutcheons engaging opposite sides of a door, a bolt reciprocable between an extended position in which it projects from a swingable edge of said door and a retracted position in which it is disposed within said door, a face plate overlying said edge and having a bolt aperture therein through which said bolt can move, an externally threaded lock cylinder including a rotatable core adapted to receive a key, and a linkage connecting said lock cylinder to said bolt, wherein the improvement comprises:

an internally threaded ring-shaped holder in which said cylinder is threadedly mounted, said holder having at least one lug projecting outwardly therefrom adjacent said core;

an aperture of generally circular outline in one of said escutcheons in which said holder is removably received and is rotatable between a secured position and a released position;

retaining means disposed between said escutcheons for normally securing said holder to said apertured escutcheon and for releasing said holder upon actuation thereof, said retaining means comprising a latch member movable toward and away from said holder for engagement with said lug, and spring means for resiliently urging said latch member toward said holder, said latch member and said lug having cam surfaces that are mutually engageable upon rotation of said holder; and a release aperture in said face plate by which said retaining means is accessible for actuation thereof to disengage said latch member from said lug by moving said latch member against the urging of said spring means, thereby permitting said holder to be rotated from said secured position to said released position.

2. A door lock including a pair of escutcheons engaging opposite sides of a door, a bolt reciprocable between an extended position in which it projects from an edge of said door and a retracted position in which it is disposed within said door, a face plate overlying said edge and having a bolt aperture therein through which said bolt can project, a lock cylinder, and linkage means for connecting said cylinder to said bolt, wherein the improvement comprises:

a holder in which said cylinder is mounted;

a holder aperture in one of said escutcheons in which said holder is removably received; and retaining means for normally securing said holder within said holder aperture and for releasing said holder for removal from said holder aperture upon actuation thereof, said release means being disposed between said escutcheons and accessible from said edge of said door.

3. The door lock of claim 2 wherein:

said retaining means includes a movable latch member; and said holder has a cam surface thereon positioned to engage and move said latch member as said holder is inserted in said holder aperture.

4. The door lock of claim 2 wherein:

said holder is rotatable between a secured position and a released position; and said retaining means normally prevents rotation of said holder but when actuated permits rotation of said holder.

5. The door lock of claim 4 wherein said retaining means comprises a latch member and resilient means for urging said latch member toward a holder-retaining position.

6. The door lock of claim 2 wherein:

said holder defines a recess; and said retaining means comprises a movable latch member and spring means for resiliently urging said latch member toward said recess.

7. The door lock of claim 2 wherein:

said holder is ring-shaped having at least one outwardly protruding lug thereon; and said apertured escutcheon has an abutment thereon positioned for engagement by said lug upon rotation of said holder.

8. The door lock of claim 7 wherein said retaining means comprises:

a movable lock member; and spring means for resiliently biasing said lock member toward a position in which it is engageable with said lug.

9. The door lock of claim 2 wherein:

said holder includes a lug positioned to be engageable with said apertured escutcheon to retain said holder therein; and said cylinder includes an eccentric core adapted to receive a key, said lug being positioned adjacent said core.

10. The door lock of claim 2 wherein:

said holder is ring-shaped and rotatable within said holder aperture and has at least one outwardly projecting lug thereon;

said retaining means includes a movable latch member and spring means for biasing said latch member toward said holder; and said lug and said latch member have cam surfaces that are mutually engageable upon rotation of said holder to cause movement of said latch member.

11. The door lock of claim 2 wherein said holder has at least two spaced apart outwardly projecting lugs thereon engageable with said apertured escutcheon to retain said holder therein.

12. The door lock of claim 2 wherein said face plate has an aperture therein through which said retaining means is accessible.

13. A door lock comprising:

a mounting structure secured to a door;

a bolt movable between a retracted position within said mounting structure and an extended position in which it projects from an edge of said door;

lock cylinder means for moving said bolt between said retracted and extended positions;

a holder in which said cylinder is mounted; and retaining means accessible from said edge of said door for normally securing said holder to said mounting structure and for releasing said holder upon actuation thereof.

14. The door lock of claim 13 wherein said cylinder is externally threaded and said holder is internally threaded.

15. The door lock of claim 13 wherein said retaining means comprises a latch member and spring means for urging said latch member toward a holder-engaging position.

16. The door lock of claim 15 wherein said holder includes a recess in which said latch member is received when in said holder-engaging position.

17. The door lock of claim 13 wherein said retaining means comprises a latch member movable toward and away from said edge of said door, said latch member being engageable with said holder.

18. The door lock of claim 13 wherein said retaining means includes a set screw engageable with said holder.

* * * * *